US007393294B2

(12) United States Patent
Filice et al.

(10) Patent No.: US 7,393,294 B2
(45) Date of Patent: Jul. 1, 2008

(54) BALL CATCHING AND DELIVERY FRAME WITH VARIABLE FLEX

(75) Inventors: Gary Filice, Moorpark, CA (US); Dean E. Meyer, Oak Brook, IL (US); Larry Carlson, Santa Clara, CA (US)

(73) Assignee: Easton Sports, Inc., Van Nuys, CA (US)

( * ) Notice: Subject to any disclaimer, the term of this patent is extended or adjusted under 35 U.S.C. 154(b) by 162 days.

(21) Appl. No.: 11/103,165

(22) Filed: Apr. 11, 2005

(65) Prior Publication Data

US 2006/0040771 A1 Feb. 23, 2006

Related U.S. Application Data

(60) Provisional application No. 60/560,999, filed on Apr. 9, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 3,507,495 | A | 4/1970 | Tucker | |
| RE31,419 | E | 10/1983 | Frolow | |
| 4,657,260 | A | 4/1987 | Brine | |
| 5,290,039 | A | 3/1994 | Cornelio | |
| 5,494,297 | A | 2/1996 | MacNeil | |
| 5,566,947 | A | 10/1996 | Tucker | |
| 5,568,925 | A | 10/1996 | Morrow | |
| 5,816,960 | A * | 10/1998 | Svoma et al. | 473/549 |
| 6,066,056 | A | 5/2000 | Morrow | |
| 6,241,629 | B1 * | 6/2001 | Otto | 473/457 |
| 6,447,410 | B2 | 9/2002 | Crawford | |
| 6,852,047 | B2 | 2/2005 | Tucker | |
| 2004/0058758 | A1 | 3/2004 | Kohler | |
| 2005/0075200 | A1 * | 4/2005 | Brine et al. | 473/513 |

* cited by examiner

*Primary Examiner*—Eugene Kim
*Assistant Examiner*—M. Chambers
(74) *Attorney, Agent, or Firm*—Perkins Coie LLP

(57) ABSTRACT

A ball catching and delivery head including a frame and a base for a lacrosse stick is provided. In addition to a socket for receiving a handle, the base includes a cavity for receiving a flexible cartridge and also trusses laterally located relative to the base that terminally connect with the frame and the base. The frame is vertically flexible relative to the base and the extent to which the frame is so flexible is dependent upon the cartridge flexibility and compressibility. The trusses prevent lateral movements of the frame relative to the base. Different cartridges made of different materials may be substituted for one another to achieve different flexing characteristics.

77 Claims, 13 Drawing Sheets

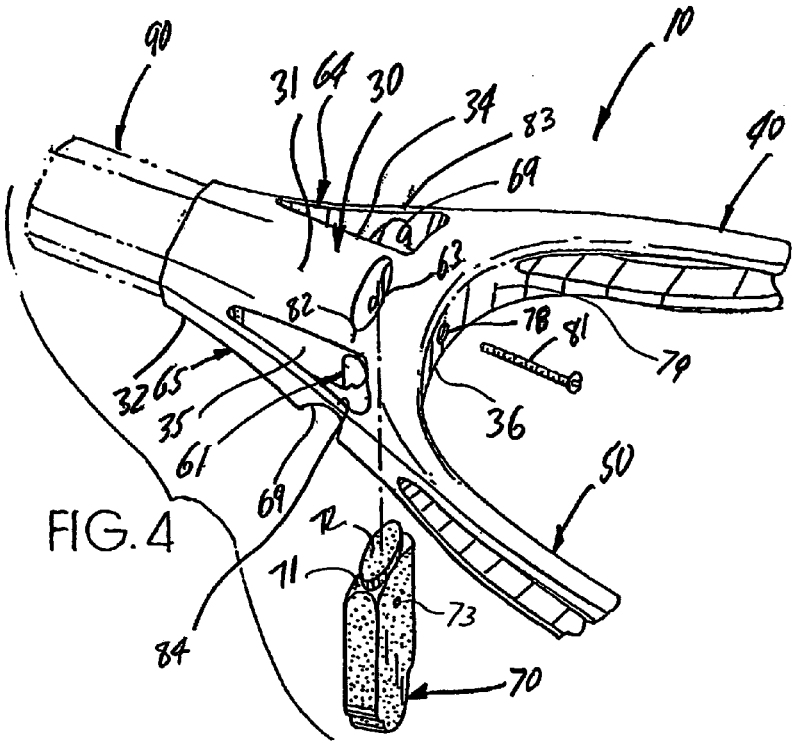
FIG. 4
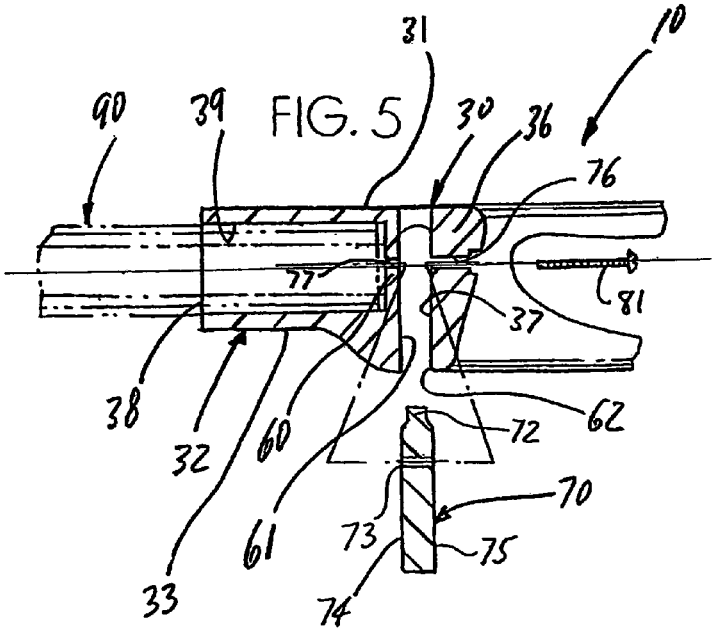
FIG. 5
FIG. 5A
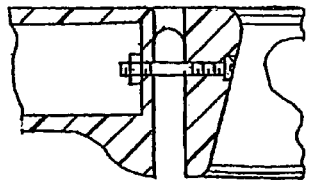

FIG. 8A
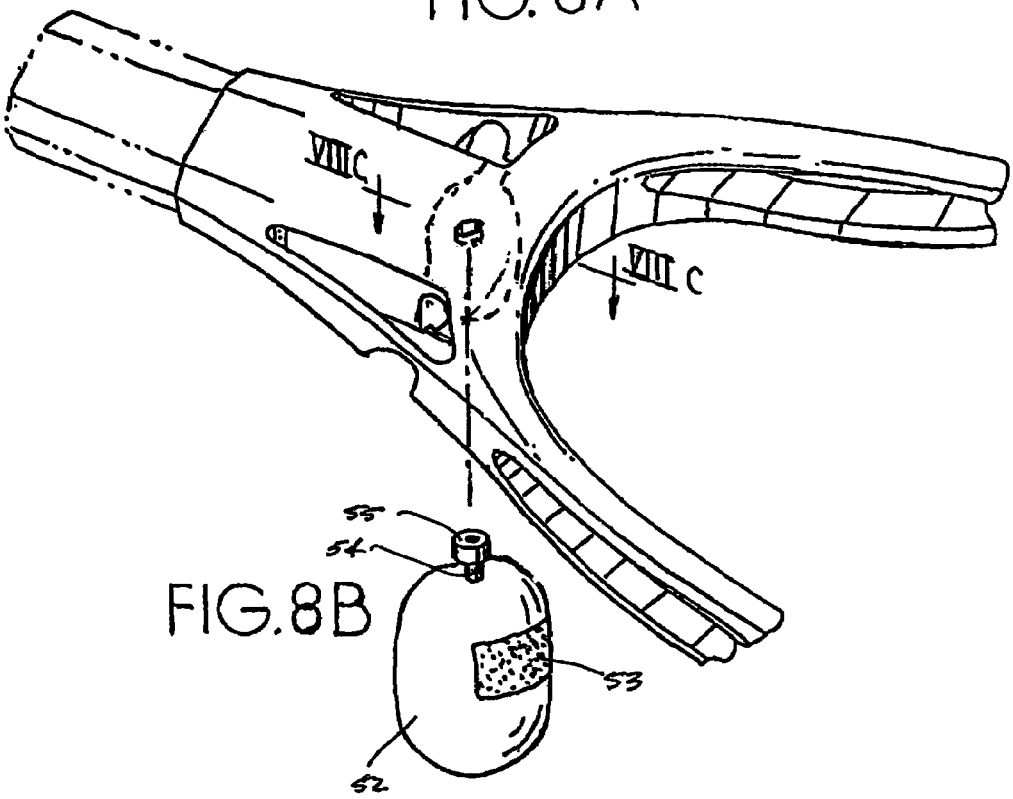
FIG. 8B
FIG. 8C
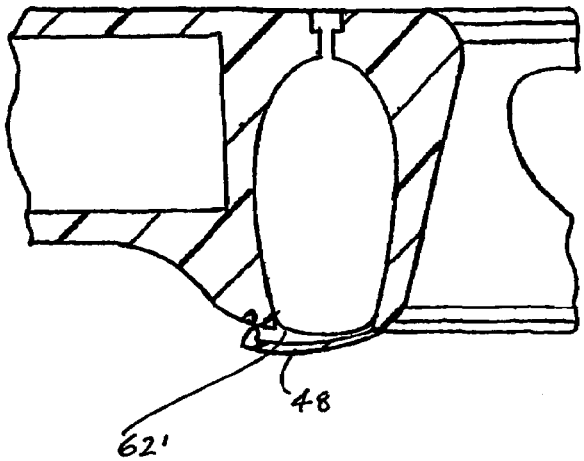

FIG. 9A
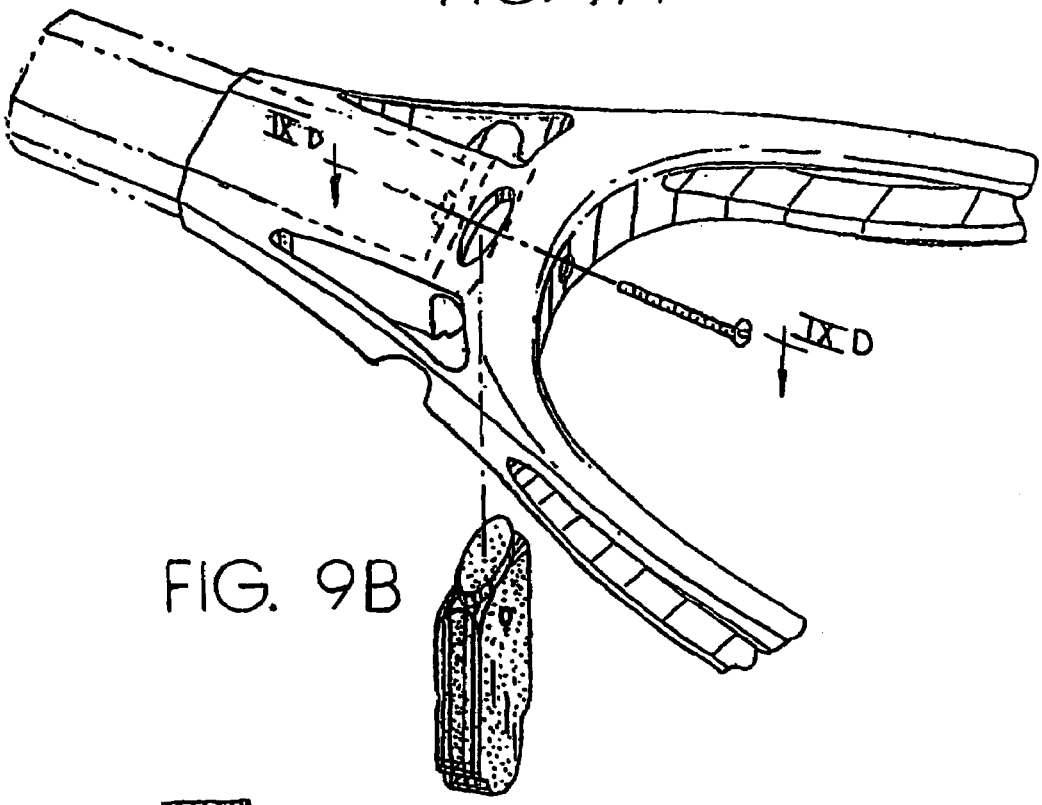
FIG. 9B
FIG. 9C
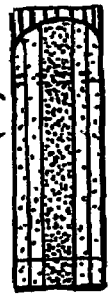
FIG. 9D
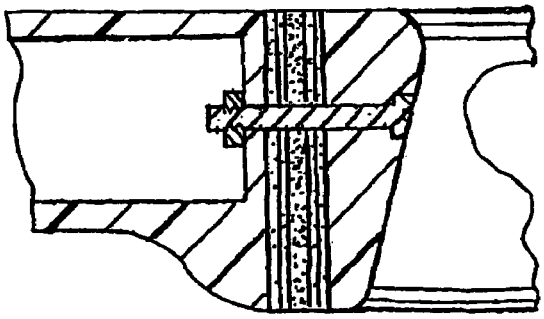

FIG. 14A
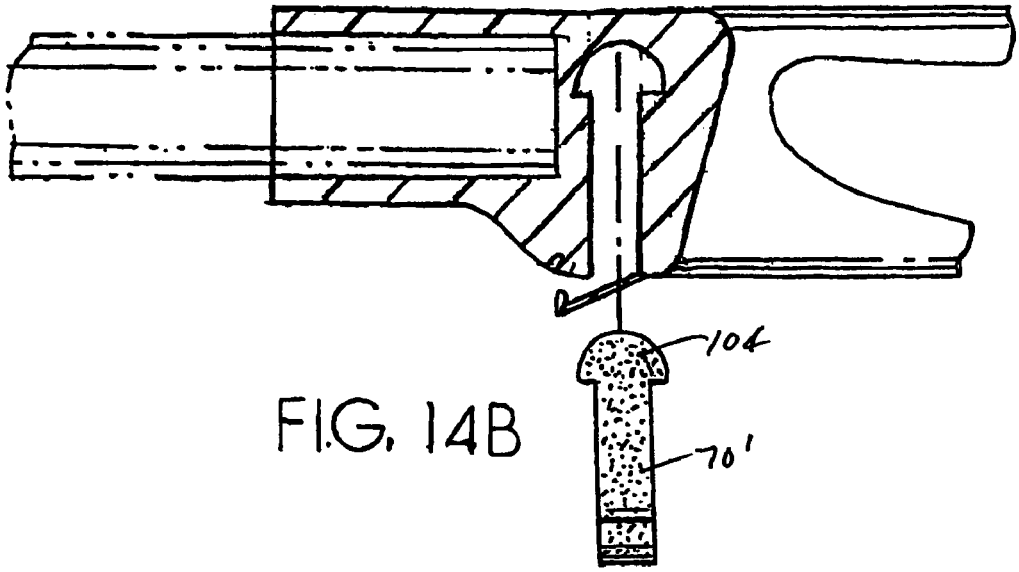
FIG. 14B
FIG. 14C
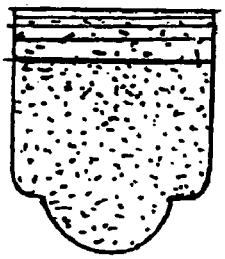

BALL CATCHING AND DELIVERY FRAME WITH VARIABLE FLEX

CROSS REFERENCE TO RELATED APPLICATION

This application claims priority from Provisional Patent Application No. 60/560,999, filed Apr. 9, 2004, the disclosure of which is incorporated herein by reference in its entirety.

FIELD OF THE INVENTION

The present invention relates to a ball catching and delivery frame and, more particularly, to the frame of the head of a lacrosse stick in combination with an associated base which is characterized by variable flex in directions generally vertical to the frame.

BACKGROUND OF THE INVENTION

A ball catching and delivery frame of the type used in the head of a lacrosse stick employed in the sport of lacrosse and relating to the subject of the present invention is variously fabricated but is believed to be most typically made of an injection-molded, monolithic, durable and rigid material such as, for example, nylon, urethane or polycarbonate.

The flexing capability of current lacrosse heads is determined by the configuration of the head and the resiliency and flexibility of the material from which the head is constructed. Unfortunately, however, the flex characteristics are not currently customizable or adjustable by the player to meet his/her playing style or needs.

Thus, there remains a need for a head with a frame and a base whose flexing capabilities can be varied and customized to meet a particular player's needs or playing style.

SUMMARY OF THE INVENTION

The present invention is directed to a ball catching and delivery head for use with a lacrosse stick in the playing of the game of lacrosse.

The head incorporates a frame that is associated with a base. The base, in addition to including a handle associating portion (preferably a socket) for mounting and holding a handle, incorporates a socket or cavity holding a flexible cartridge structure. The flexible cartridge structure permits the frame to be flexed in a generally perpendicular direction (relative to the frame) during catching, holding and launching of a ball.

However, in accordance with the invention, because of truss members that are associated with the frame and the base and that extend on lateral opposite sides of the base, the frame is restrained from lateral flexural movements relative to the base.

The frame of the head can be generally conventionally constructed. Thus, the frame typically includes an aft ball back stop wall, a pair of laterally spaced sidewalls that each extend outwardly from a different opposite end of the ball back stop wall, and a forward arcuate member to whose respective opposite ends each connect with a different sidewall.

The base is integrally or unitarily joined to the ball back stop wall and, as is conventional in such a base, incorporates a socket structure that is useful for connection with and mounting of a handle structure. The base can be constructed, if desired, of conventional materials using conventional construction methodology.

In accordance with the invention, the base incorporates both at least one (preferably one) cavity (or recess or socket) that is adapted to receive and hold at least one flexible cartridge and also truss members that limit lateral movement of the frame relative to the base.

A flexible cartridge structure (or flex member) can be variously comprised.

In one embodiment of the present invention, a flex member is associated with the base of the frame. More particularly, the base defines first and second hollow sockets where the first socket extends generally along the major axis and is adapted to receive the proximal end of a lacrosse stick handle and the second socket is adapted to receive the flex member. The second socket preferably extends transversely through a portion of the base in a direction generally normal to the first socket and to the major axis. The flex member may be made from a suitable compressible or resilient elastomeric plastic material and is preferably adapted to be fitted in the second socket through an access opening defined in the base. A fastening member that extends through the back stop wall of the head and into the flex member secures the flex member with the base interior.

The base also includes an upper face defining a through aperture and the cartridge includes an outstanding finger formed thereon that is preferably adapted to be fitted in the aperture in the upper face of the base when the cartridge is received in the second socket.

In another embodiment, the frame may be comprised mainly of a first material. The regions of the base and/or sidewalls about which the frame may be flexed may comprise unitary regions made of a second material which is more compressible or resilient than the first material.

Other embodiments of the invention are illustrated.

Various objects, features, advantages, aims and the like of the present invention will be readily apparent from the following detailed description of the preferred embodiments of the invention, the accompanying drawings, and the appended claims.

BRIEF DESCRIPTION OF THE DRAWINGS

In the Drawings:

FIG. 4 is a fragmentary perspective view of a top portion of the head of FIG. 1 showing the base and its sleeve component and aft portions of the sidewalls of the head of FIG. 1, the flexible cartridge and its mounting screw each being shown in an exploded configuration;

FIG. 5 is a fragmentary vertical longitudinal cross-section view through the base and its sleeve component of the head of FIG. 1, the flexible cartridge and its mounting screw each being shown in an exploded configuration;

FIG. 5A is fragmentary vertical longitudinal cross-sectional view through the base and its sleeve component similar to FIG. 5 but illustrating the manner in which a nut and bolt assembly is employed to retain a flexible cartridge in association with a cavity in the base;

FIGS. 8A-8C illustrate an alternative embodiment of the invention wherein the flexible cartridge is comprised of a fluid inflated bladder with FIG. 8B showing an illustrative bladder and FIG. 8C showing a vertical longitudinal cross section through a mid-region of the base;

FIGS. 9A-9D illustrate an alternative embodiment of the invention similar to that shown in FIGS. 1-5A but wherein the flexible cartridge is comprised of various layers of elastomeric materials, as illustrated in the perspective view of FIG. 9B, and as illustrated in the vertical sectional view of FIG. 9C with FIG. 9D illustrating the use of a cartridge retaining bolt analogous to FIG. 5A (above);

FIGS. 14A-14C illustrate an alternative embodiment of the invention similar to that shown in FIGS. 1-5A but wherein the flexible cartridge along its top edge portion is associated with a broadened head portion that is adapted to be received in a cavity having a corresponding mating enlargement with the bottom portion of the cartridge being regained in the cavity by a snap fit band that extends longitudinally over and across the cartridge bottom, thereby avoiding the use of a bolt and nut assembly for cartridge retention in the base cavity, the FIG. 14B being a vertical longitudinal sectional view through the cartridge, and the FIG. 14C being a side elevational view of the cartridge.

DETAILED DESCRIPTION OF PREFERRED EMBODIMENTS

Figure 1:
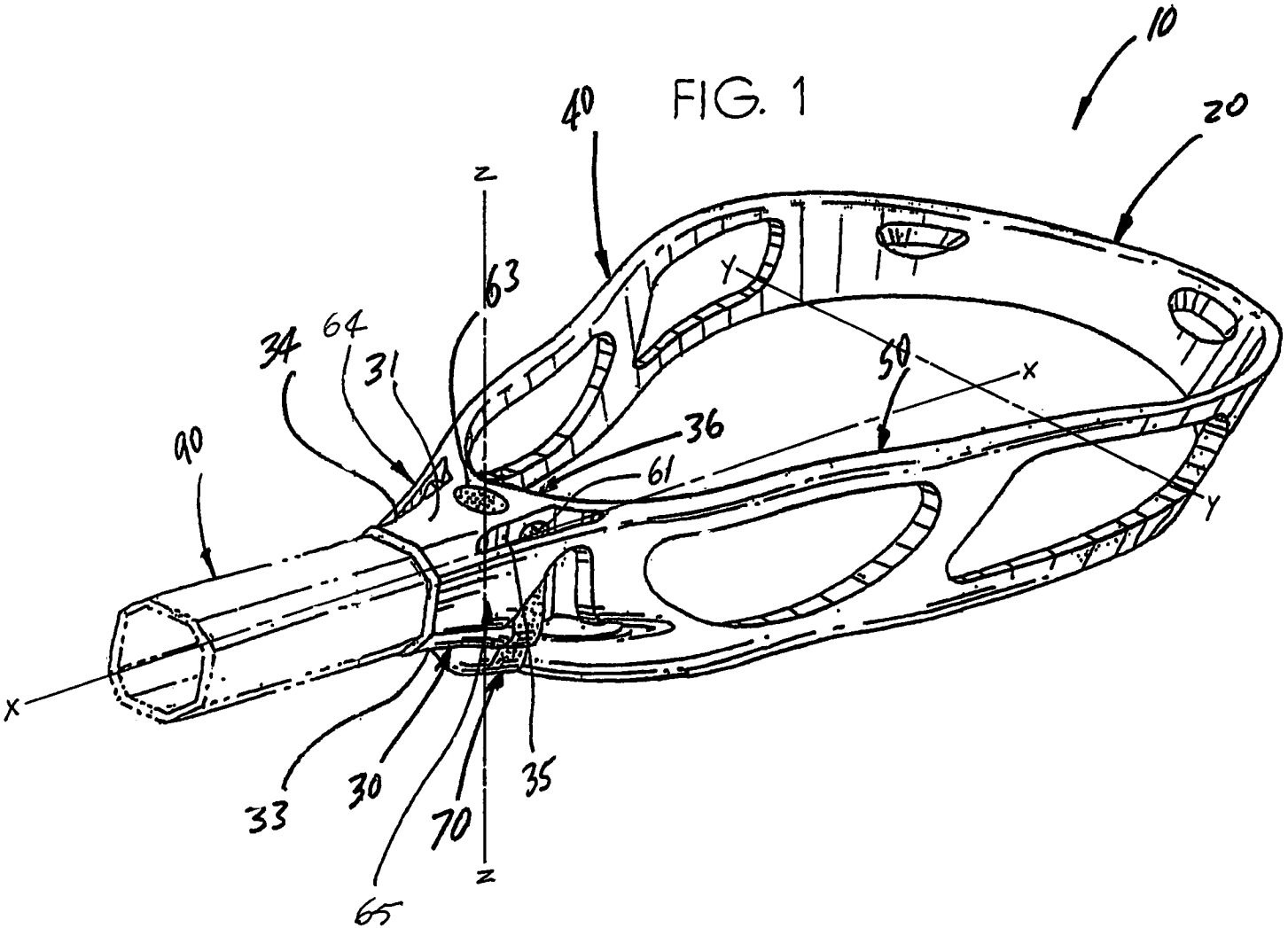
FIG. 1 is a perspective view of a lacrosse head constructed in accordance with the present invention showing the head frame (having a longitudinal major axis x and a transverse minor axis y) and the base, including a flexible cartridge (preferably extending generally along a vertical axis z), and further including an illustrative fragmentary phantom handle in association therewith, but not showing the ball receiving net structure normally associated with the frame.
Figure 2:
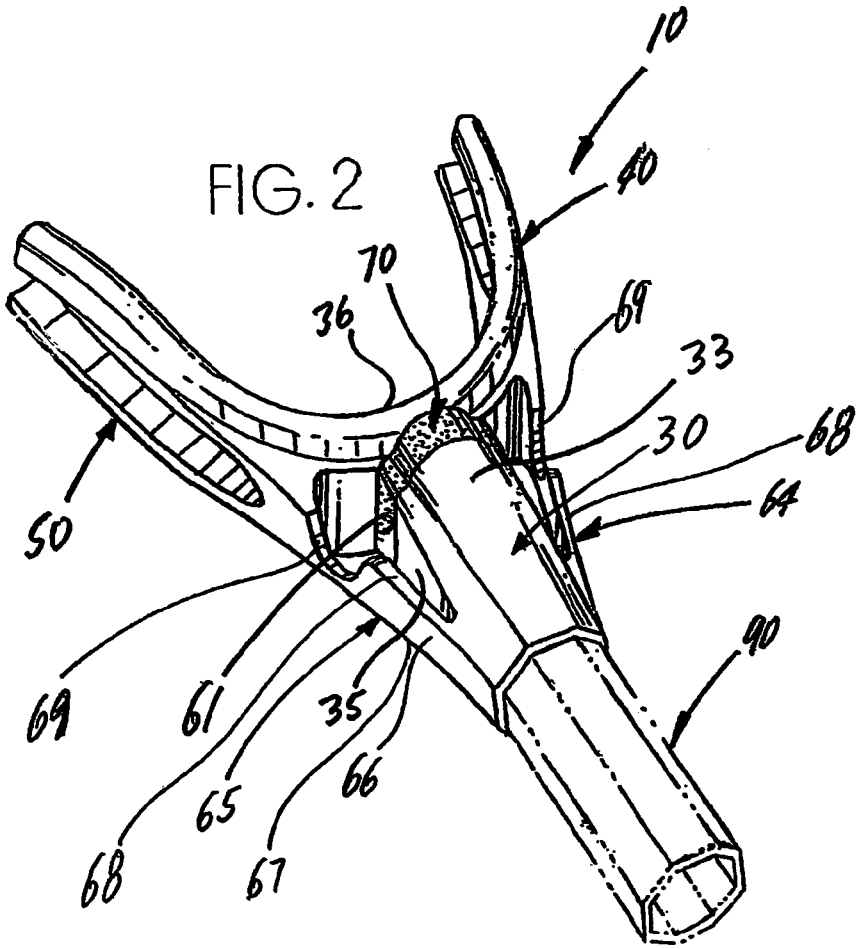
FIG. 2 is a fragmentary perspective view of the bottom of the head of FIG. 1 showing the base and its sleeve component, aft portions of the head of FIG. 1 and the flexible cartridge.

The invention disclosed herein is, of course, susceptible of embodiment in many different forms. Shown in the drawings and described herein below in detail is a preferred embodiment of the frame of the present invention. It is to be understood, however, that the present disclosure is an exemplification of the principles of the invention and does not limit the invention to the illustrated embodiment.

For ease of description, the lacrosse stick frame and head of the present invention are described herein below with reference to the general horizontal position as shown in, for example, FIG. 1 and orientation and terms such as upper, lower, vertical, etc., will be used herein with reference to this usual orientation.

It is also understood that the FIGURES herein do not necessarily show or describe all details of the lacrosse stick head that are known in the art and that will be recognized by those skilled in the art as such. The detailed descriptions of such elements are not necessary to an understanding of the invention. Accordingly, such elements are represented, shown and described herein generally only to the degree necessary to aid in an understanding of the features of the lacrosse stick head of the present invention.

In general, a "flex member" or "flexible cartridge" herein is characteristically resilient, elastic or elastomeric and compressible, as explained and illustrated herein.

Figure 3:
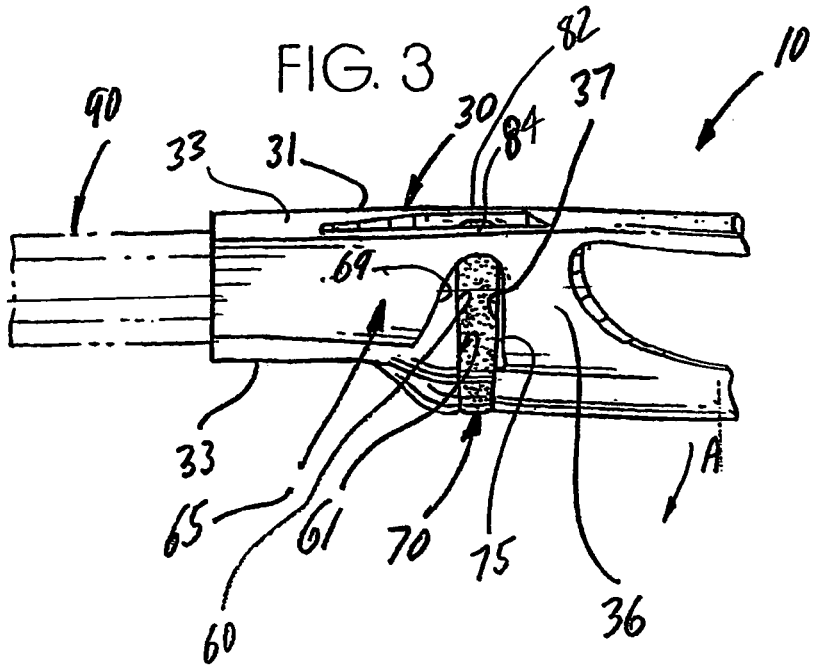
FIG. 3 is a fragmentary side elevational view of the base and its sleeve component, aft portions of the frame of the head of FIG. 1 and the flexible cartridge, the frame of the head being shown in a downwardly flexed position relative to the base with the flexible cartridge being shown in a compressed condition.

FIGS. 1-5 depict an embodiment of the inventive lacrosse stick head, the head including a frame 10 in which a flexible cartridge (or member, or wedge) 70 is associated with and located in the base 30 that is associated with the frame 10. The flexible cartridge 70 and the base 30 allow the frame 10 to flex about the base 30 as shown in FIG. 3.

The base 30, which includes top and bottom faces 31 ane 33, respectively, and also opposed sides faces 34 and 35, respectively, incorporates an integral hollow sleeve 32 (see, for example, FIG. 5). The base 30 forward portion integrally joins an arcuately extending ball back stop wall 36 of the frame 10. The sleeve 32 extends unitarily rearwardly and centrally from the base 30 and the back or aft face 37 of the back stop wall 36.

Frame 10 additionally defines a pair of laterally spaced sidewalls 40 and 50 that each extend unitarily and forwardly from opposed side end portions of the back stop wall 36. A forwardly located, arcuately extending scoop wall 20, located opposite and forward of the back wall 36, extends unitarily between, and has opposite end portions that each join, a different one of the fore sections of the respective sidewalls 40 and 50.

The frame 10 can be variously fabricated and is conveniently made, for example, from a suitable injection-molded, monolithic, durable and rigid materials such, as for example, nylon, urethane, polycarbonate or the like. The frame 10 can be peripherally extending, generally oval and symmetrically configured with a longitudinal major axis x and a transverse minor axis y as shown in FIG. 1. Thus, the frame 10 defines respective forward and aft frame portions with intervening frame side portions and is configured to receive a lacrosse ball.

Sleeve 32 defines an open distal end 38 (see, for example, FIG. 5) and an interior longitudinally extending handle socket 39 adapted to receive the proximal end of a lacrosse stick handle 90. According to the invention, socket 39 terminates in a vertical interior radially extending wall 60 (relative to socket 39) that is located within the interior of sleeve 32. Sleeve wall 60 is spaced from and positioned in an orientation generally and preferably parallel to the back stop wall 36 and defines a generally vertically oriented hollow and open cartridge socket 61 extending through the base 30 in a direction preferably along axis z, opposite and transverse to the socket 39 and to the longitudinal axis of sleeve 32. Sockets 61 defines an access opening 62 in the bottom face 33 of base 30 and open windows 91 in the side faces 34 and 35, respectively, of base 30.

The top face 31 of base 30 additionally defines a through aperture or window 63 which, in the embodiment shown, is generally and preferably oval in cross-sectional shape. Window 63 is in communication with the interior of cartridge socket 61.

Base 30 additionally includes a pair of elongate side truss members 64 and 65 each extending unitarily and generally horizontally and laterally adjacent to and spaced from the respective sides faces 34 and 35 between the open distal end 38 of sleeve 32 and a different portion of the back face 37 of ball back stop wall 36. Truss members 64 and 65 each diverge laterally outwardly from the sleeve distal end 38 in the direction of the ball back stop wall 36. Each of the truss members 64 and 65 includes a body 66 and top and bottom longitudinal edges 67 and 68, respectively (see, for example, FIG. 2). Each of the truss members 64 and 65 defines a notch 69 which is cut out or formed in each of the bottom edge 68 and body 66 of the respective truss members 64 and 65. Notch 69 terminates at a point short of the top edge 67 of each of the respective truss members 64 and 65. Each of the notches 69 is preferably in the shape of a "U" as viewed from the perspective of FIG. 2. Notches 69 are generally vertically co-planarly aligned with the cartridge socket 61.

In accordance with the invention, truss members 64 and 65 not only function in combination with laterally adjacent portions of the base to define flex hinges, as described in more detail below, but also structural frame members which provide and reinforce the strength of the base 30 and the frame 10 in lateral directions. Thus, the truss members 64 and 65 function to prevent the side-to-side (lateral) movements of the frame 10 relative to the base 30.

The flex member or flexible cartridge 70 may be made from any suitable compressible or resilient material, such as, for example, any one or a combination of the following types of rubber: styrene butadiene (SBR), ethylene-propylene (EP), polyurethane (PU), a latex or ionomer, a Neoprene® type elastomer, or the like.

As shown, for example, in FIGS. 4 and 5, a cartridge 70 is preferably shaped and sized so as to be fitted and extended into the socket 61 defined in the base 30 through the lower opening 62 defined in the bottom face 33 thereof. Cartridge 70 conveniently and preferably includes a top face 71 having a finger 72 protruding outwardly and preferably vertically therefrom. The finger 72 is preferably sized and shaped to engage and fit within the window 63 defined in the top face 31 of the base 30 and overlying the socket 61. The combination of the finger 72 and the window 63 are thus preferably adapted to locate and position the cartridge 70 within the socket 61.

Cartridge 70 additionally preferably defines a through bore 73 which extends between the side faces 74 and 75 thereof and is adapted for co-linear alignment with a through bore 76 which extends through both the ball back stop wall 36 and a through bore 77 that extends through the sleeve distal end wall 60. Bore 76 defines an aperture 78 in the interior face 79 of ball back stop wall 36. Through the bore 76 a fastening member, such as for example a mounting bolt 81 shown in FIGS. 4 and 5, or the like, is adapted to be successively extended through the bore 76 in back stop wall 36, the bore 73 in cartridge 70, and the bore 77 in sleeve end wall 60 and threadably associated with a nut 86 for fastening the cartridge 70 within the interior of socket 61.

In accordance with the present invention, cartridge 70 is intended and designed to allow the vertical flex in the frame 10 relative to the base 30 to be varied and customized as explained in more detail below.

The head defines respective hinges 82, 83 and 84 in the top of the base 30 and truss members 64 and 65, respectively, along sides of the base 30. The frame 10 and, more particularly, the sidewalls 40 and 50 and scoop wall 20 thereof, are adapted to flex downwardly in the direction of arrow A as viewed from the perspective of FIG. 3, i.e., in an inclined plane spaced from a horizontal plane extending through the top face 33 of base 30. Hinges 82, 83 and 84 are defined respectively by the portion of the base 30 overlying the socket 61, and the portions of the top edges 67 of the truss members 64 and 65 overlying the notches 69 formed respectively therein.

It is also understood that, as frame 10 is flexed downwardly away from and relative to the horizontal plane of the base 30, as illustratively shown in FIG. 3 about hinges 82, 83 and 84, such as occurs in usage of the inventive lacrosse head, for example, in the course of receiving, passing or shooting a lacrosse ball, the back face 37 of back stop wall 36 is pressed against the side face 75 of cartridge 70, which, in turn, causes the transverse compression of the cartridge 70 since cartridge 70 is wedged between sleeve wall 60 and back stop wall 36. In accordance with the present invention, the extent and degree to which frame 10 may be flexed about and relative to the base 30 is dependent upon the extent and degree to which cartridge 70 is compressed and compressible which, in turn, are dependent upon the resiliency or compressibility of the material from which the cartridge 70 is made. Thus, for example, where a player's preference is for a head with maximum flexibility, cartridge 70 may be made of a material with enhanced compressibility such as, for example, SBR rubber or the like, while, in situations where minimum flexibility is desired, cartridge 70 may be made of a material such as, for example, vulcanized rubber which has minimum compressibility, or the like.

It is understood, of course, that the invention encompasses the use and substitution by the lacrosse player, if desired, of any one of several different cartridges that are each composed of materials of different compressibility, thus allowing a player to customize the flex characteristics of the head of his lacrosse stick depending upon the player's preferences or needs. The present invention, for example, envisions the use of cartridges of different colors, where the colors designate materials of varying compressibility.

The invention is employable in various embodiments. Thus, in addition to the illustrative preferred embodiment shown in FIGS. 1-5A, further illustrative embodiments are shown in FIGS. 6A through 15D, as above briefly described. Where convenient, individual components similar to those identified in FIGS. 1-5A are similarly numbered but with the addition of prime marks thereto for identification purposes.

Figure 6A:
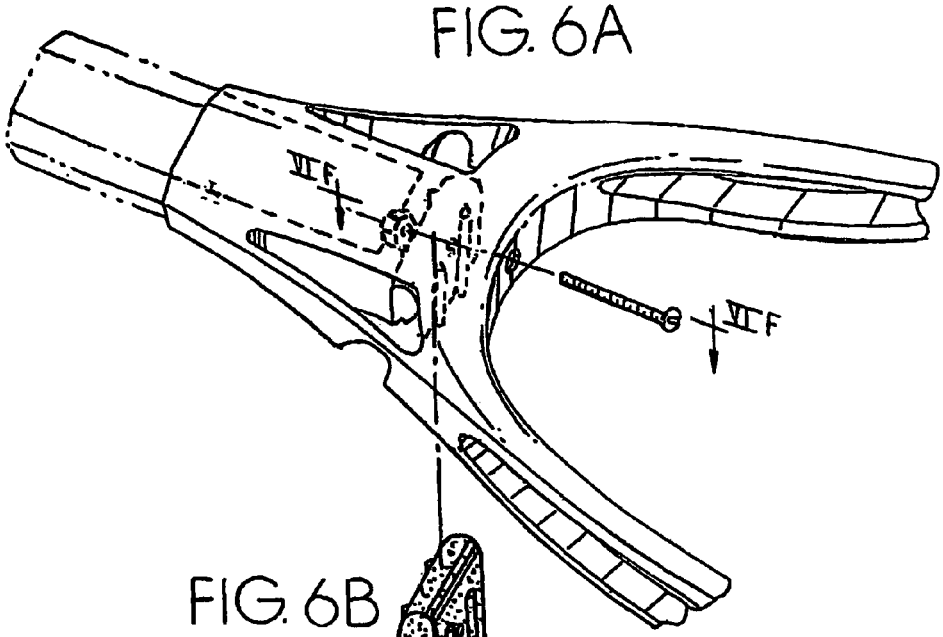
FIGS. 6A-6F illustrate an alternative embodiment of the invention similar to that shown in FIGS. 1-5A but wherein the flexible cartridge is provided on its broad side walls with either ridges (as shown in FIGS. 6B and 6C) or grooves (as shown in FIGS. 6D and 6E) and the cartridge receiving cavity in the base is provided with mating or corresponding grooves or ridges; these cartridges each being retained in association with a cartridge receiving cavity by a retaining bolt and nut as illustrated in the vertical longitudinal sectional view of FIG. 6F.
Figure 6B:
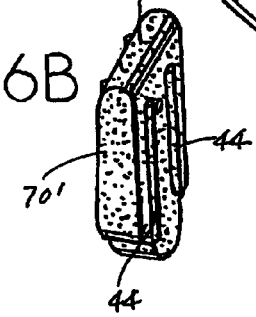
Figure 6C:
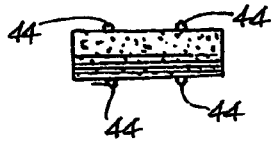
Figure 6D:
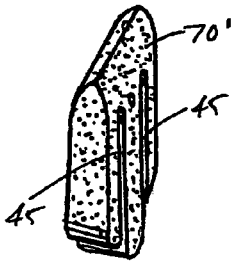
Figure 6E:
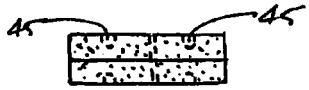
Figure 6F:
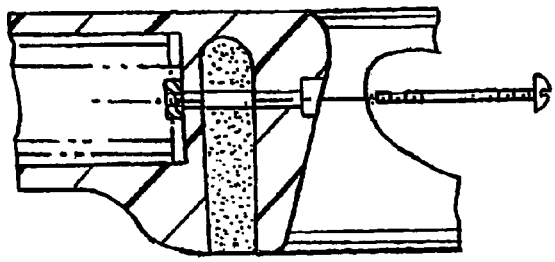

In the embodiment of FIGS. 6A-6F, the ribs 44 and the grooves 45 employed are integrally formed with the flexible cartridge 70' and are useful for maintaining a cartridge 70' in association and alignment with the base 30'. In addition, each groove 45 can define a void having a volume to allow for movement of portions of the flexible cartridge 70' upon compression, and thus provide more compressional compliance to a given hardness of rubber or like material. Each groove 45 can be formed in a surface of the flexible cartridge 70' as shown in FIG. 6E, or can extend through the cartridge from one side or face to the other.

Figure 7A:
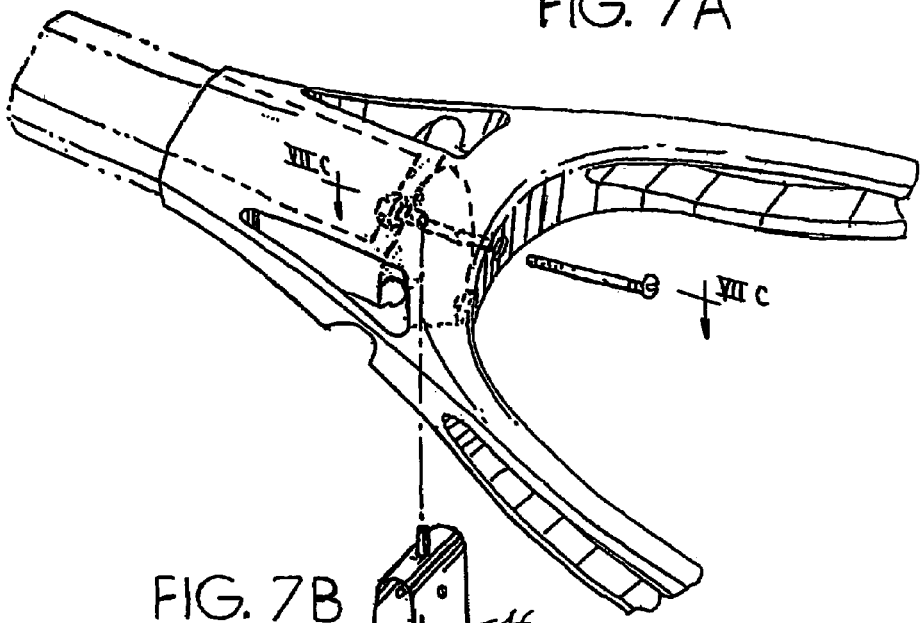
FIGS. 7A-7D illustrate an alterative embodiment of the invention wherein the flexible cartridge is comprised of a metal U-shaped leaf spring, the embodiment otherwise being similar to that shown in FIGS. 1-5A, with FIG. 7B illustrating an illustrative spring configuration, with FIG. 7C being taken along the line VIIC-VIIC of FIG. 7A and FIG. 7D corresponding to the vertical sectional view shown in FIG. 6F.
Figure 7B:
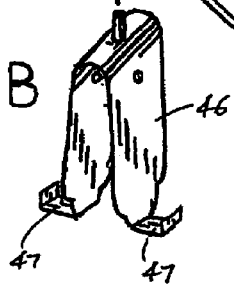
Figure 7C:
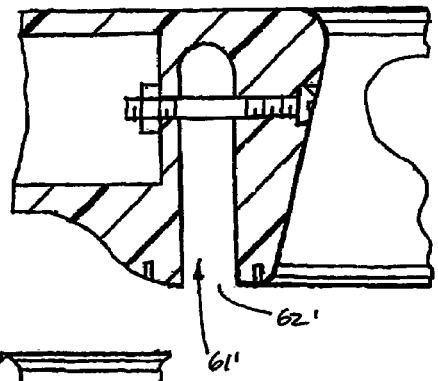
Figure 7D:
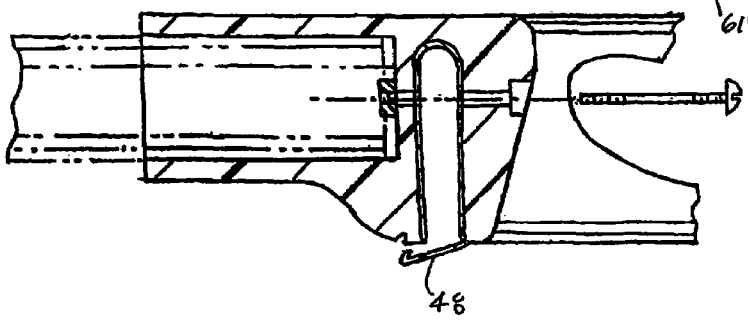

In the embodiment of FIGS. 7A-7D, the cartridge 70' is in the form of a U-shaped spring comprised of a plastic strip or a metal (preferably stainless steel sheeting). If desired, the spring 46 of cartridge 70' can be associated with an elastomeric core (not shown). Also if desired, the terminal outturned locating flanges 47 at each opposite end of the spring 46 can be eliminated, as illustrated in FIG. 7D, and, if desired, the lower access aperture 62' of socket (or cavity) 61' can be closed with a plastic strap 48 or the like.

Conveniently, the beginning end of the strap 48 is mounted to the base 30 bottom face 33, and the terminal end of the strap 48 is provided with a snap-fit connector 49 that engages a recess formed in the bottom face 33. To avoid potential seizing between the spring 46 and retaining nut and bolt assembly 81' during flexural movements of the frame 10' relative to the base 30 in use of the embodiment, the spring 46 is provided with oversize holes through which the bolt 81' is extended.

In the embodiment of FIGS. 8A-8C, the bladder 52 is illustratively associated with the base 30' by a double-faced adhesive strip 53 and by a stem 54 on valve 55 which stem 54 seats in the window 63' of the top face 31'of base 30'. The pressurizing fluid admitted to or removed from the valve 55 can be a liquid or a gas (preferably air). The opening 62' can be closed with a strap 48 as in the embodiment of FIGS. 7A-7D.

The embodiment of FIGS. 9A-9D is similar to that of FIGS. 1-5A but here the cartridge is multilayered with each layer characterized by a different compressibility, thereby to provide either progressive increasing or progressive decreasing compressibility as frame 10' flexure occurs relative to base 30', as maybe desired by a lacrosse player.

Figure 10A:
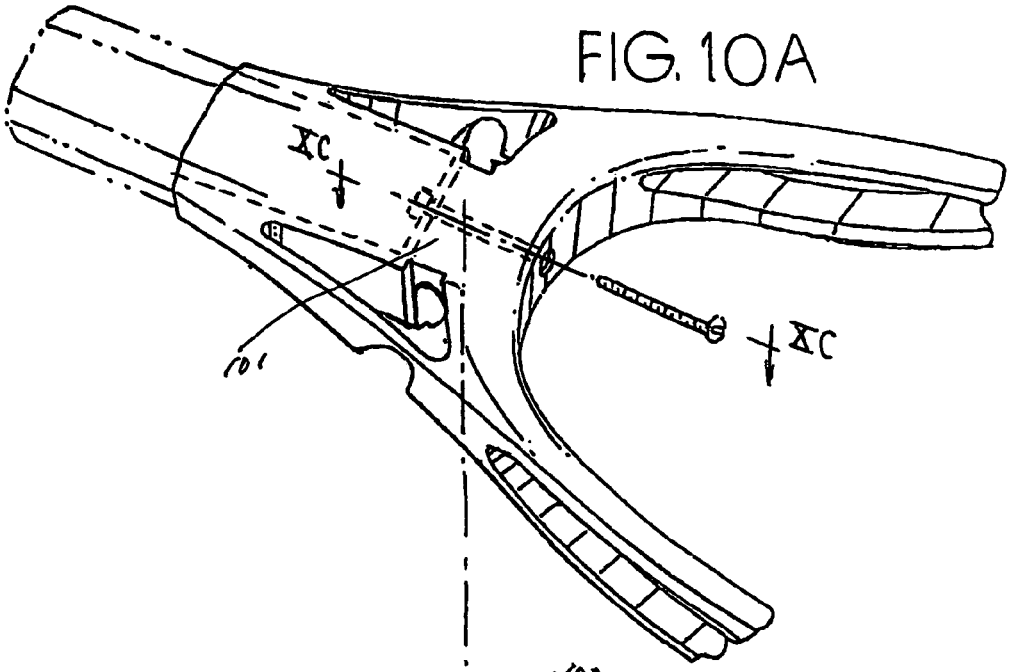
FIGS. 10A-10C illustrate an alternative embodiment of the invention similar to that shown in FIGS. 1-5A but wherein the flexible cartridge along its top edge portion is associated with a snap fit band that extends over and around an upper portion of the base as shown in the perspective view of FIG. 10B, thereby to reinforce the flexible region of the base and also to provide an option for retaining the flexible cartridge in association with the cartridge receiving cavity, although optionally, and as shown, this embodiment is illustrated further in association with a cartridge retaining bolt in FIG. 10C which is analogous to FIG. 5A (above)
Figure 10B:
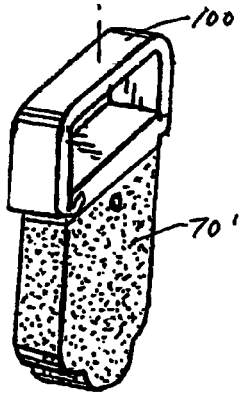
Figure 10C:
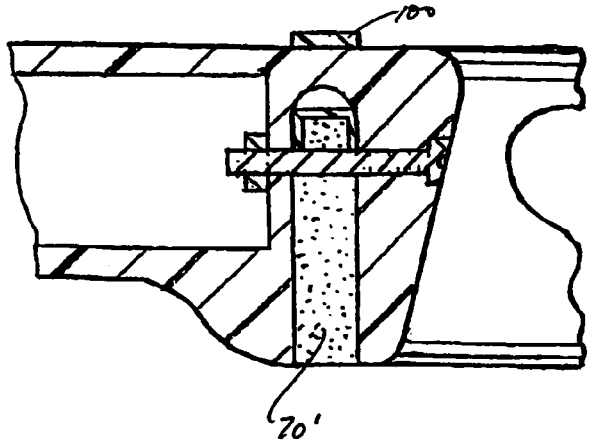

The embodiment of FIGS. 10A-10C is similar to that of FIGS. 1-5A, but the flexible cartridge includes a snap-fit band 100 along its top edge portion that extends over and around an upper portion 101 of the base as shown in FIG. 10B. This arrangement reinforces the flexible region of the base and provides an optional configuration for retaining the flexible cartridge 70' within the cartridge receiving cavity. Optionally, or in addition, a retaining screw or bolt can be used in an analogous manner as in FIG. 5A. From a player's standpoint, one possible objection to this embodiment is that the top edge portion of the flexible cartridge may interfere with the smoothness of the base. This objection could be circumvented by including a recessed portion (not shown) in the upper surface of the base configured to receive the snap-fit band and maintain a smooth or flush appearance for the base.

Figure 11:
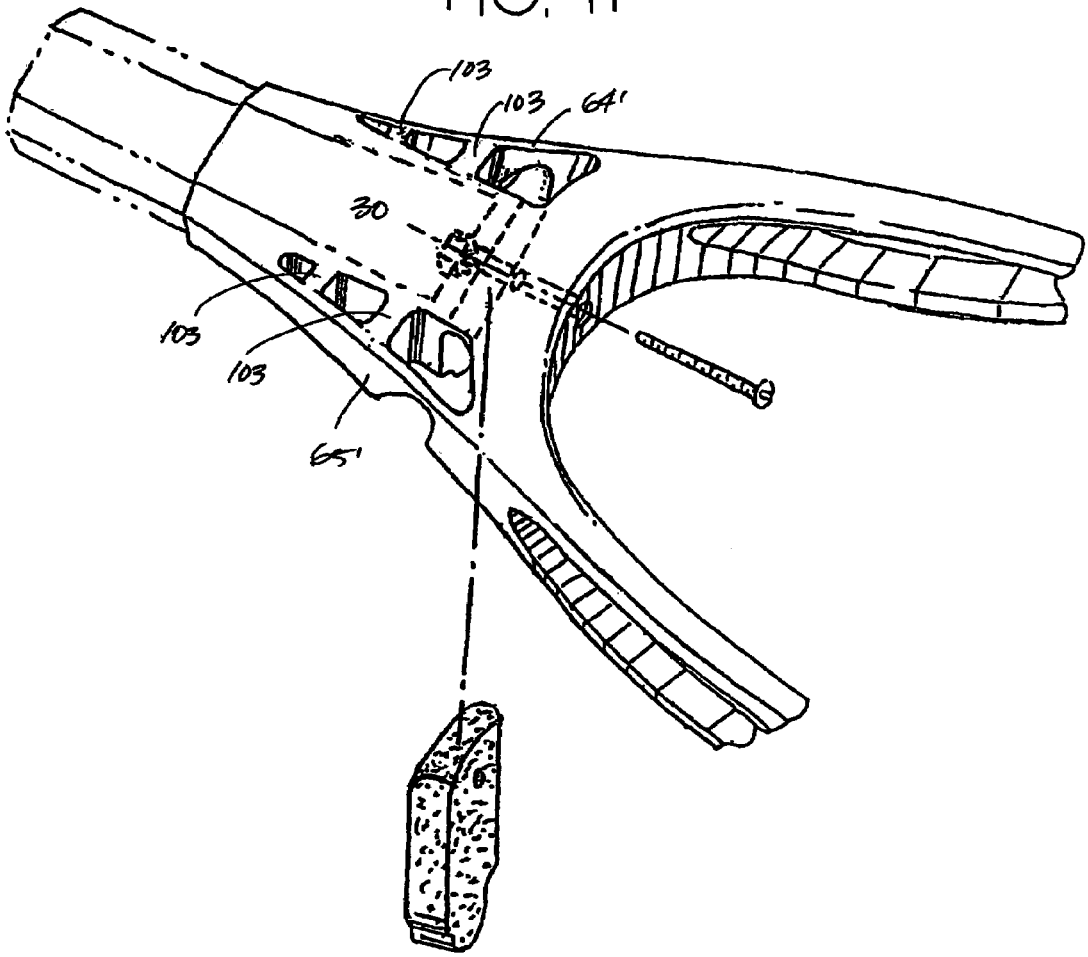
FIG. 11 illustrates an alternative embodiment of the invention similar to that shown in FIGS. 1-5A (particularly FIG. 4 above) but wherein the truss members are each strengthened laterally by a plurality of ribs interconnecting each truss member with the adjacent lateral side of the adjacent base, the cushioning cartridge here employed being similarly retained by a cartridge retaining nut and bolt assembly.

The embodiment of FIG. 11 illustrates one manner in which the side trusses 64' and 65' can be strengthened. Here, lateral ribs 103 extend between each truss and the laterally adjacent base 30'.

Figure 12A:
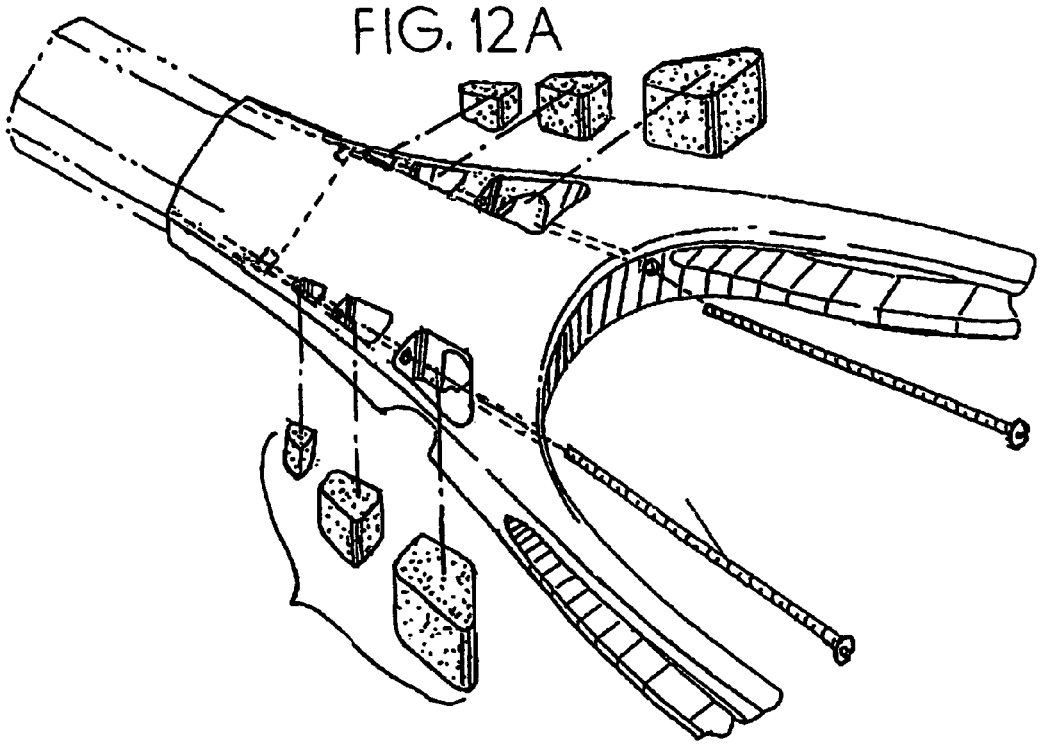
FIGS. 12A-12B illustrate an alternative embodiment of the invention similar to that shown in FIG. 11 but wherein a plurality of discrete cushioning cartridges are employed so that a set of three longitudinally spaced but separate cartridges is located each in a separate cavity adjacent each lateral side portion of the base, the orientation of each set being shown in an exploded configuration for illustration, and with each set being retained by a single elongated retaining bolt in association with a nut, as illustrated in the vertical longitudinal sectional view shown in FIG. 12B and also in FIG. 12A.
Figure 12B:
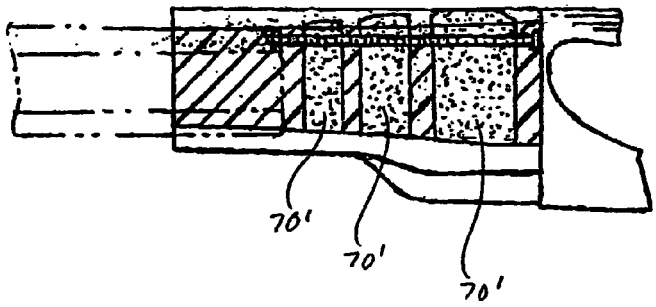
Figure 13A:
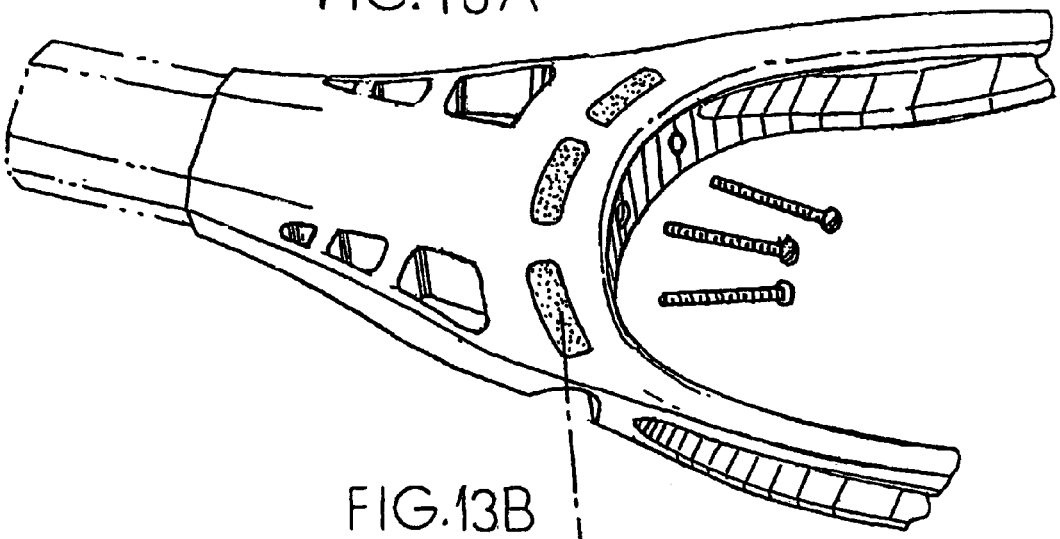
FIGS. 13A-13D illustrate an alternative embodiment of the invention similar to that shown in FIG. 11 but wherein a transversely broadened cushioning cartridge arrangement is employed which in the illustrative arrangement shown in FIGS. 13A and 13B is comprised to three separate cartridges in a spaced, adjacent side-by-side, curved relationship, each cartridge having an upper seating and positioning projection that is received in and through top portions of the base and retained by separate retaining bolts, and which in the illustrative arrangement shown in FIGS. 13C and 13D is comprised to a single broad cartridge in a curved configuration with three upper seating and positioning projections that are received in and through top portions of the base and that are optionally retained by both bolts (not detailed)
Figure 13B:
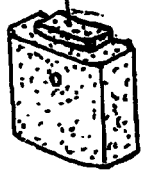
Figure 13C:
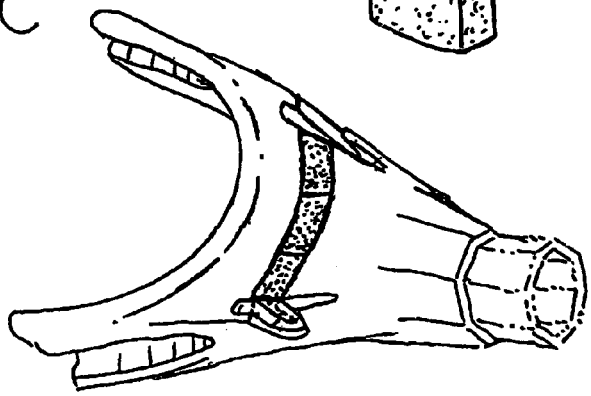
Figure 13D:
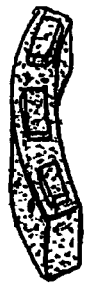
Figure 15A:
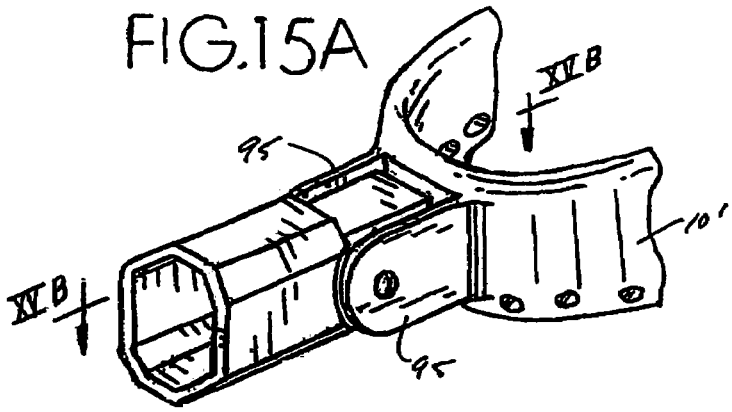
FIGS. 15A-15D illustrate an alternative embodiment of the invention wherein the flexing regions provided, for example, in the embodiments of FIGS. 1-5A are replaced by a hinge structure with the various spring or elastomeric cartridge components controlling the flexibility of the articulated area.
Figure 15B:
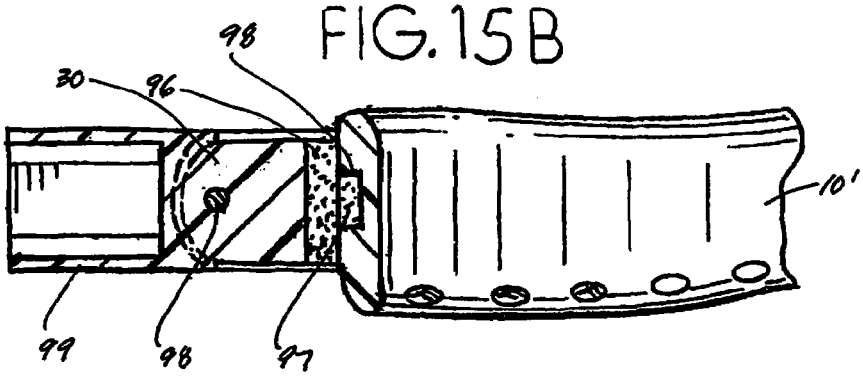
Figure 15C:
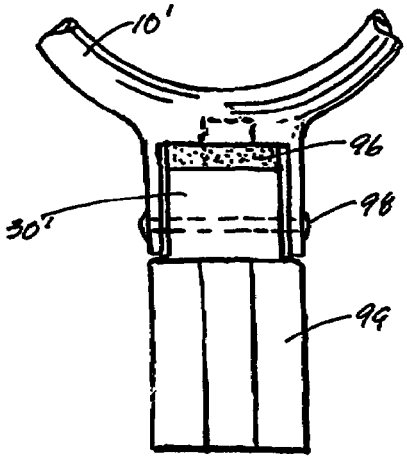
Figure 15D:
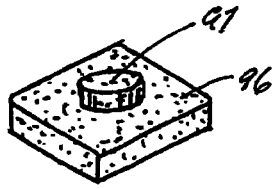

The embodiment of FIGS. 12A and 12B illustrate the employment of a plurality of cartridge assemblies 70' which are illustratively provided in a base/truss structure such as illustrated in FIG. 11. The cartridge plurality can be structured to have an additive compressibility effect compared to, for example, a single cartridge to provide additional flexural capability in the head.

The embodiments of FIGS. 13A-13D illustrate the employment of a cartridge system which has a curvature, the curvature here illustratively being similar to that in the aft portion of the frame 10'.

The embodiment of FIGS. 14A-14C illustrates an alternative technique for securing a cartridge to a base. In associating this illustrative cartridge with the base, the frame is flexed upwardly to spread the aperture 62 to receive the enlarged cartridge head 104.

In the embodiment of FIGS. 15A-15D, the flexural hinge structure employed in the preceding embodiments is replaced by a pivot hinge structure 94. Here, the head 10' is articulated through the hinge structure 94 relative to hinge pin 98. This embodiment is desirable particularly when the head 10' is molded of a very rigid fiber reinforced polymeric material that will not flex without fracture. The spring rate of the articulated area can be here controlled through the use of the particular elastomeric or spring-like cartridge elements such as hereinabove illustrated.

In FIGS. 15A-15D, the frame 10' is conveniently provided with a pair of perimetrically spaced side ears or trusses 95. The space between the ears 95 provides a cavity for holding an elastomeric cartridge element 96 or the like. The cartridge element 96 is preferably and illustratively provided with a key projection 97 that is configured to fit into a receiving depression 98 in the frame 10' base, and the base 30' is articulated relative to the ears 95 by a hinge pin (or pintle) 98. Rearwardly from the base 30' extends a socket 99 for a handle (not shown).

If desired, a pivot hinge structure can be utilized in or on the top portion of the base, preferably over a cartridge (not shown).

It will be readily apparent from the foregoing detailed description of the invention and from the illustrations thereof that numerous variations and modifications may be effected without departing from the true spirit and scope of the novel concepts or principles of this invention. For example, it is understood that the invention encompasses other lacrosse head embodiments wherein the cartridge, instead of being a separate interchangeable part, is a portion unitary with the base which has been made and molded from a material more elastically compliant than the material forming the remainder of the base and frame. The invention also encompasses devices other than those used in the sport of lacrosse, where flexibility of the frame relative to a base thereof may be desirable.

We claim:

1. A ball catching and delivery head that includes a frame joined to a base and configured with a longitudinal major axis, the base defining a flexing region that permits the frame to flex relative to said base, said flexing region including a cavity having a central axis that is generally perpendicular to the major axis, said cavity receiving a bias member to resist said flex and to limit lateral movements of said head relative to said base, whereby said frame is flexibly moveable perpendicularly relative to said major axis and relative to said base generally about said bias member while said frame resists lateral movement and wherein the base includes an upper surface defining an aperture in communication with said cavity, said bias member includes a top face having a finger, and said finger extends into said aperture when said bias member is received in said cavity.

2. The head of claim 1 wherein said base includes a handle associating portion that extends in a direction generally along the longitudinal major axis.

3. The head of claim 1 further comprising a fastening member that secures said bias member within said cavity.

4. The head of claim 1 wherein said bias member is comprised of resilient compressible material.

5. The head of claim 1 wherein said flexible region comprises a portion of said base of reduced cross-sectional area compared to the remainder of said base.

6. The head of claim 1 wherein said flexible region comprises an articulated hinge.

7. The head of claim 1 wherein said base defines a hollow socket adapted to receive the proximal end of a lacrosse stick.

8. The head of claim 1 wherein said frame includes a ball back stop wall adjacent said base defining a portion of said cavity and said cavity provides reversible engagement for reversibly receiving and engaging said cartridge.

9. The head of claim 8 wherein said reversible engagement extends through said ball back stop wall so as to extend into said cartridge.

10. The head of claim 1 wherein said bias member comprises a molded compressible elastomeric material.

11. The head of claim 1 wherein said frame is comprised of a first material and said flexible region is comprised of a second material.

12. The head of claim 11 wherein said second material is resiliently compressible.

13. The head of claim 11 wherein said second material is resilient.

14. The head of claim 1 wherein at least one truss member that extends along and is associated with a portion of said base, said at least one truss member extending between a fixed association with said frame and a fixed association with said base, whereby said frame resists said lateral movements.

15. In a lacrosse head of the type having a frame and an associated base, said frame configured with a longitudinal major axis, the improvement being achieved by:

incorporating into said base a flexible region for bending in a direction generally perpendicular to said major axis of said frame, relative to an aft portion of said base;

providing a compressible, resilient, elastic cartridge; and providing said flexible region with a cavity having a central axis that is generally perpendicular to the major axis, providing reversible engagement for reversibly receiving and engaging said cartridge, whereby said frame is flexibly moveable relative to said major axis and relative to said cartridge with said cartridge resisting said bending and wherein the base includes an upper surface defining an aperture in communication with said cavity, said bias member includes a top face having a finger, and said finger extends into said aperture when said bias member is received in said cavity.

16. The head of claim 15 wherein said base defines a hollow socket adapted to receive the proximal end of a lacrosse stick.

17. The head of claim 16 wherein said cartridge comprises a molded compressible elastomeric material.

18. The head of claim 15 wherein said frame includes a ball back stop wall adjacent said base defining a portion of said cavity.

19. The head of claim 18 wherein said reversible engagement extends through said ball back stop wall so as to extend into said cartridge.

20. The head of claim 15 wherein said base includes an upper face that defines a through aperture.

21. The head of claim 20 wherein said cartridge includes a finger received in said through aperture.

22. The head of claim 15 wherein said frame is comprised of a first material and said flexible region is comprised of a second material.

23. The head of claim 22 wherein said second material is compressible.

24. The head of claim 22 wherein said second material is resilient.

25. The head of claim 15 wherein said base defines a lower face, and said cavity defines an opening in said lower face through which said cartridge is received.

26. The head of claim 15 wherein at least one truss member that extends along and is associated with a portion of said base.

27. The head of claim 26 wherein a top portion of said base is of reduced cross-sectional area compared to the remainder of the base, extends over said bias member and is longitudinally flexible, whereby said frame is flexibly moveable relative to said base and to said bias member.

28. The head of claim 26 wherein said at least one truss member extends between a fixed association with said frame and a fixed association with said base, whereby said frame resists said lateral movements.

29. The head of claim 26 wherein a top portion of said base extends over said cartridge and is longitudinally flexible, whereby said frame is flexibly moveable relative to said base and to said cartridge.

30. The head of claim 29 wherein said top portion comprises a portion of said base of reduced cross-sectional area compared to the remainder of the base.

31. The head of claim 29 wherein said top portion comprises a hinge.

32. The head of claim 15 further comprising a fastening member that secures said bias member within said cavity.

33. The head of claim 15 wherein said base defines a hollow sleeve adapted to receive the proximal end of a lacrosse stick.

34. The bead of claim 15 wherein said cartridge comprises a flexible, resilient, elastomeric body.

35. A head of a lacrosse stick comprising:

a) a frame configured with a longitudinal major axis, including a base defining:

a hollow socket extending longitudinally though said base and adapted to receive the proximal end of a lacrosse stick handle, and a flexing region with a cavity extending though said base for flexing of said frame, the cavity having a central axis that is generally perpendicular to the major axis; and b) a wedge of compressible material received in said cavity to resist flexing of said frame with respect to said base and wherein the base includes an upper surface defining an aperture in communication with said cavity, said bias member includes a top face having a finger, and said finger extends into said aperture when said bias member is received in said cavity.

36. The bead of claim 35 wherein the base includes an upper surface defining an aperture in communication with said cavity, said wedge includes a top face having a finger, and said finger extends into said aperture when said bias member is received in said cavity.

37. The head of claim 35 further comprising a fastening member that secures said wedge within said cavity.

38. The head of claim 35 wherein said wedge is comprised of resilient compressible material.

39. The head of claim 35 wherein said second socket provides reversible engagement for reversibly receiving and engaging said wedge.

40. The head of claim 35 wherein said frame is comprised of a first material and said flexible region is comprised of a second material.

41. The head of claim 40 wherein said second material is resiliently compressible.

42. The head of claim 40 wherein said second material is resilient.

43. The head of claim 35 wherein said base defines a lower face, and said cavity defines an opening in said lower face through which said wedge is received.

44. The head of claim 35 wherein said base further includes a lateral stiffener to resist lateral flexing of said portion of said frame forward of said pocket at an angle to the first direction.

45. The head of claim 35 wherein said flexing region comprises a portion of said base of reduced cross-sectional area compared to the remainder of said base.

46. The head of claim 35 wherein said flexing region comprises an articulated hinge.

47. In a lacrosse stick of the type having a handle joined to a heads the improvement which comprises providing a flexural capability in said head, said improvement being achieved by:

(A) said head having a frame with a longitudinal major axis, said frame defining respective upper and lower frame portions with intervening frame side portions, said frame being configured for receiving therein a ball of the type conventionally employed in playing of the game lacrosse;

(B) said head further having a base, with a flexible region and a handle-receiving socket that extends generally outwardly from said frame and generally along said major axis for receiving a handle, and a cartridge-receiving cavity in said flexible region tat extends generally perpendicularly relative to said major axis, for receiving a cartridge;

(C) a resilient, compressible cartridge received in said cavity so as to resist flexing of said flexible region;

(D) the relationship between said cartridge and said base being such that said cartridge yieldingly biases said base and said frame in a normally major axis alignment wherein said cartridge resists downward movement of said frame relative to said base.

48. The lacrosse stick of claim 47 wherein said base further includes lateral portions that retards said frame from deflecting laterally relative to said base.

49. The head of claim 47 wherein said flexible region comprises a portion of said base of reduced cross-sectional area compared to the remainder of said base.

50. The head of claim 47 wherein said flexible region comprises an articulated hinge.

51. The head of claim 47 wherein said frame is comprised of a first material and said flexible region is comprised of a second material.

52. The head of claim 47 wherein said second material is resiliently compressible.

53. The lacrosse stick of claim 47 further comprising structural members extending exteriorly along opposite portions of said base and interconnecting said base with said frame in laterally adjacent relationship to said cavity, for resisting lateral side movements of said frame relative to said base, and permitting downward movement of said lower frame portions relative to said base in the flexible region in response to downwardly exerted force exerted against said upper frame portions.

54. In a lacrosse stick of the type comprising a frame configured with a longitudinal major axis, defining a head and including a generally broad forward portion, a rearward portion that is narrower than said forward portion, and a pair of elongated side portions located along opposed sides of said head;

a ball-receiving net structure situated within said frame and having edge portions secured to said frame;

a base rearwardly extending from fixed association with said rearward portion and defining therein a rearwardly opening, longitudinally-extending socket for receiving and holding therein a forward end portion of a handle shaft, the improvement which comprises:

defining in said base a flex region with at least one pocket-like cavity between said socket and said rearward portion, said cavity having a central axis that is generally perpendicular to the major axis;

said flex region permitting portions of said base located forward of said pocket-like cavity to deflect relative to said base; and a resilient cartridge in said pocket cavity;

the interrelationship between said frame, said net structure, said base, said pocket-like cavity and said cartridge as located in said pocket-like cavity being such that when a ball lands in said net structure, said cartridge is compressed and downward deflection of said frame is resisted by said cartridge.

55. The head of claim 54 wherein said flex region comprises a portion of said base of reduced cross-sectional area compared to the remainder of said base.

56. The head of claim 54 wherein said flex region comprises an articulated hinge.

57. The head of claim 54 wherein said frame is comprised of a first material and said flex region is comprised of a second material.

58. The head of claim 54 wherein said second material is resiliently compressible.

59. The head of claim 54 wherein said base further includes a lateral stiffener to resist lateral flexing of said portion of said frame forward of said pocket at an angle to the first direction.

60. A head for a lacrosse stick comprising:

a frame configured with a longitudinal major axis, defining a head and including a generally broad forward portion, a rearward portion that is narrower than said forward portion;

a ball-receiving net structure situated within said frame and having edge portions secured to said frame;

a base portion rearwardly extending from fixed association with said rearward portion and defining therein a rearwardly opening, longitudinally-extending socket for receiving and holding therein a forward end portion of a handle shaft, at least one pocket-like cavity between said socket and said rearward portion, said cavity having a central axis that is generally perpendicular to the major axis;

a resilient cartridge in said cavity;

said base including a flexing region containing said pocket-like cavity;

so that, when force is applied to said net structure, said cartridge is compressed so as to resist said frame being deflected relative to said base and wherein the base includes an upper surface defining an aperture in communication with said cavity, said bias member includes a top face having a finger, and said finger extends into said aperture when said bias member is received in said cavity.

61. The head of claim 60 wherein a fastening member extends through said cartridge for securing said cartridge in said base.

62. The head of claim 60 wherein said base includes an upper surface defining an aperture and wherein said cartridge include a finger adapted to be fitted with said aperture when said cartridge is received in said base.

63. The head of claim 62 wherein said base includes a sleeve that defines the socket for the handle shaft, and said sleeve includes a radially disposed distal end wall, and said cavity is defined between said radial distal end wall of said sleeve and said back stop wall of said base.

64. The head of claim 60 wherein said flexing region comprises a portion of said base of reduced cross-sectional area compared to the remainder of said base.

65. The head of claim 60 wherein said flexing region comprises an articulated hinge.

66. The head of claim 60 wherein said cartridge comprises flexible, resilient, elastomeric body.

67. The head of claim 60 wherein said frame includes a back stop wall adjacent to said base, and said cavity is defined behind said ball back stop wall.

68. The head of claim 60 wherein said frame is comprised of a first material and said flexing region is comprised of a second material.

69. The head of claim 60 wherein said second material is resiliently compressible.

70. The head of claim 60 wherein said base further includes a lateral stiffener to resist lateral flexing of said portion of said frame forward of said pocket at an angle to the first direction.

71. A head for a lacrosse stick comprising:

an elongated frame extending along a longitudinal major axis;

a generally broad forward portion;

a rearward portion that is narrower than said forward portion and cooperates with the forward portion to support a ball-receiving net;

a socket portion defining a rearwardly opening, longitudinally-extending socket for receiving a handle shaft;

a base portion between the socket portion and said rearward portion, defining a flex portion containing at least one cavity having a central axis that is generally perpendicular to the major axis;

said flex portion disposing portions of said frame forward of said cavity to flex with respect to portions of said frame rearward of said cavity, when subjected to forces extending at an angle to said longitudinal major axis; and a resilient member in said cavity resisting flexing of said flex portion, whereby flexing of the forward and rearward portions of the head is resisted by said resilient member wherein said resilient member comprises a cartridge with a resilient, elastomeric body.

72. The bead of claim 71 further comprising a fastening member that extends through said cartridge for securing said cartridge in said base.

73. The head of claim 71 wherein said base further includes a lateral stiffener to resist lateral flexing of said portion of said frame forward of said pocket at an angle to the first direction.

74. The head of claim 71 wherein said flex portion comprises a portion of said base of reduced cross-sectional area compared to the remainder of said base.

75. The head of claim 71 wherein said flex portion comprises an articulated hinge.

76. The head of claim 71 wherein said second material is resiliently compressible.

77. The head of claim 71 wherein said frame is comprised of a first material and said flexible region is comprised of a second material.

* * * * *

UNITED STATES PATENT AND TRADEMARK OFFICE

CERTIFICATE OF CORRECTION

PATENT NO. : 7,393,294 B2
APPLICATION NO. : 11/103165
DATED : July 1, 2008
INVENTOR(S) : Gary Filice, Dean E. Meyer and Larry Carlson It is certified that error appears in the above-identified patent and that said Letters Patent is hereby corrected as shown below:

Column 10, line 55, replace “bead” with -- head --.

Column 11, line 6, replace “bead” with -- head --.

Column 11, line 37, replace “heads” with -- head, --.

Column 11, line 50, replace “tat” with -- that --.

Signed and Sealed this

Twenty-fifth Day of November, 2008

JON W. DUDAS
*Director of the United States Patent and Trademark Office*